US006546563B2

(12) United States Patent
Young

(10) Patent No.: US 6,546,563 B2
(45) Date of Patent: Apr. 15, 2003

(54) SWEAT-ABSORBING HEADGEAR

(75) Inventor: Warren Young, Chang-Hwa (TW)

(73) Assignee: Procap Industrial Co., Ltd., Chang-Hwa (TW)

( * ) Notice: Subject to any disclaimer, the term of this patent is extended or adjusted under 35 U.S.C. 154(b) by 15 days.

(21) Appl. No.: 09/906,301

(22) Filed: Jul. 16, 2001

(65) Prior Publication Data

US 2003/0019013 A1 Jan. 30, 2003

(51) Int. Cl.[7] ..... A42B 1/22
(52) U.S. Cl. ..... 2/181
(58) Field of Search ..... 2/181, 170, 171, 2/183, 175.1, 184, 195.1, 195.2, 195.3, 417, 418, 181.4, 182.1, 182.2, 410, 182.5, DIG. 11

(56) References Cited

U.S. PATENT DOCUMENTS 2,445,209 A * 7/1948 Clark ..... 2/181
4,499,741 A * 2/1985 Harris ..... 2/162
4,856,116 A * 8/1989 Sullivan ..... 2/12
5,566,395 A * 10/1996 Nebeker ..... 2/181
5,632,046 A * 5/1997 Green et al. ..... 2/175.1

* cited by examiner

*Primary Examiner*—Gloria M. Hale
*Assistant Examiner*—Tejash D Patel
(74) *Attorney, Agent, or Firm*—Ladas & Parry

(57) ABSTRACT

A sweat-absorbing headgear includes a headgear body having a ring portion adapted to extend around the head of a wearer. The ring portion includes a woven elastic band section and is changeable in size due to stretchable and contractible characteristics of the woven elastic band section. The woven elastic band section is stretchable along a longitudinal direction thereof, and includes a plurality of fiber bundles which extend along the longitudinal direction and which are spaced apart transversely. The fiber bundles are stretched when the woven elastic band section is stretched, and form a plurality of sweat-absorbing fiber tufts projecting from an inner surface of the woven elastic band section when the latter returns to a normally contracted state.

3 Claims, 9 Drawing Sheets

SWEAT-ABSORBING HEADGEAR

BACKGROUND OF THE INVENTION

1. Field of the Invention

The invention relates to a headgear, more particularly to a sweat-absorbing headgear with stretchable and contractible characteristics.

2. Description of the Related Art

Referring to FIG. 1, a conventional headgear 1 primarily includes a crown portion 101 and a visor 102. The crown portion 101 has a semi-spherical shape and includes a looped marginal end 103 defining a bottom open end 104. The looped marginal end 103 includes a front portion attached to the visor 102, and a rear portion opposite to the front portion and formed with an inverted U-shape recess 105. A band unit 106 spans an open end of the recess 105. The length of the band unit 106 can be adjusted to fit the head of the wearer. The band unit 106 can be formed as, for example, a fabric strip with fasteners, as shown in FIG. 1. A sweatband 107 is usually provided along the looped marginal end 103 at an inner surface of the crown portion 101. The sweatband 107 is usually formed from a cotton cloth. The shortcoming of the aforesaid headgear 1 is that the recess 105 located at the rear portion of the looped marginal end 103 destroys the integral shape of the crown portion 101.

FIG. 2 illustrates another conventional headgear 2. The headgear 2 has a crown portion 201 with an integral appearance, and a looped marginal end 203 defining a bottom open end. An elastic fabric band is provided along the looped marginal end 203 at an inner surface of the crown portion 201 and is adapted to adjust the size of the bottom open end. However, the sweat-absorbing capability of the elastic fabric band is inferior to that of a non-elastic fabric band. Therefore, the wearer will feel uncomfortable while wearing the headgear 2.

SUMMARY OF THE INVENTION

The object of the present invention is to provide a sweat-absorbing headgear with stretchable and contractible characteristics, and capable of overcoming the aforesaid drawbacks of the prior art.

The sweat-absorbing headgear according to this invention comprises a headgear body having a ring portion adapted to extend around the head of a wearer. The ring portion includes a woven elastic band section and is changeable in size due to stretchable and contractible characteristics of the woven elastic band section. The woven elastic band section is stretchable along a longitudinal direction of the woven elastic band section, and includes a plurality of fiber bundles which extend along the longitudinal direction and which are spaced apart transversely. The fiber bundles are stretched when the woven elastic band section is stretched, and form a plurality of sweat-absorbing fiber tufts projecting from an inner surface of the woven elastic band section when the woven elastic band section returns to a normally contracted state.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
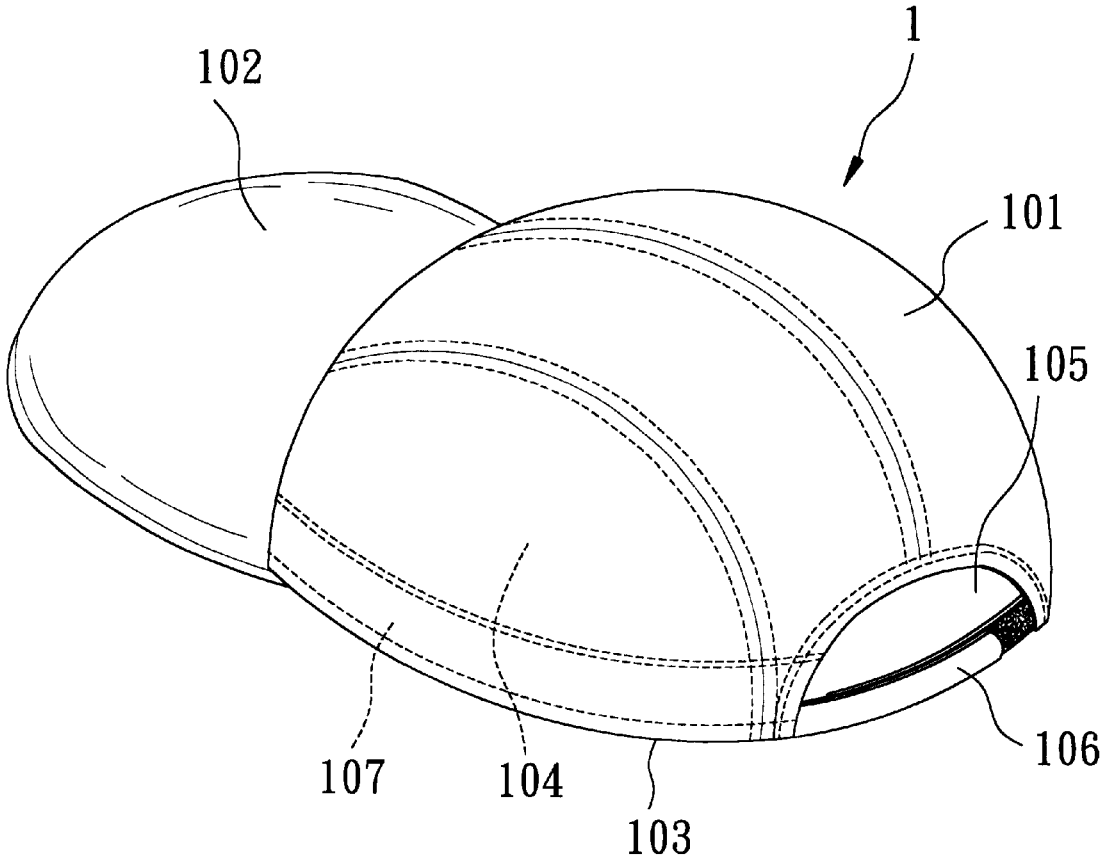
FIG. 1 PRIOR ART
FIG. 1 is a perspective view of a conventional headgear.
Figure 2:
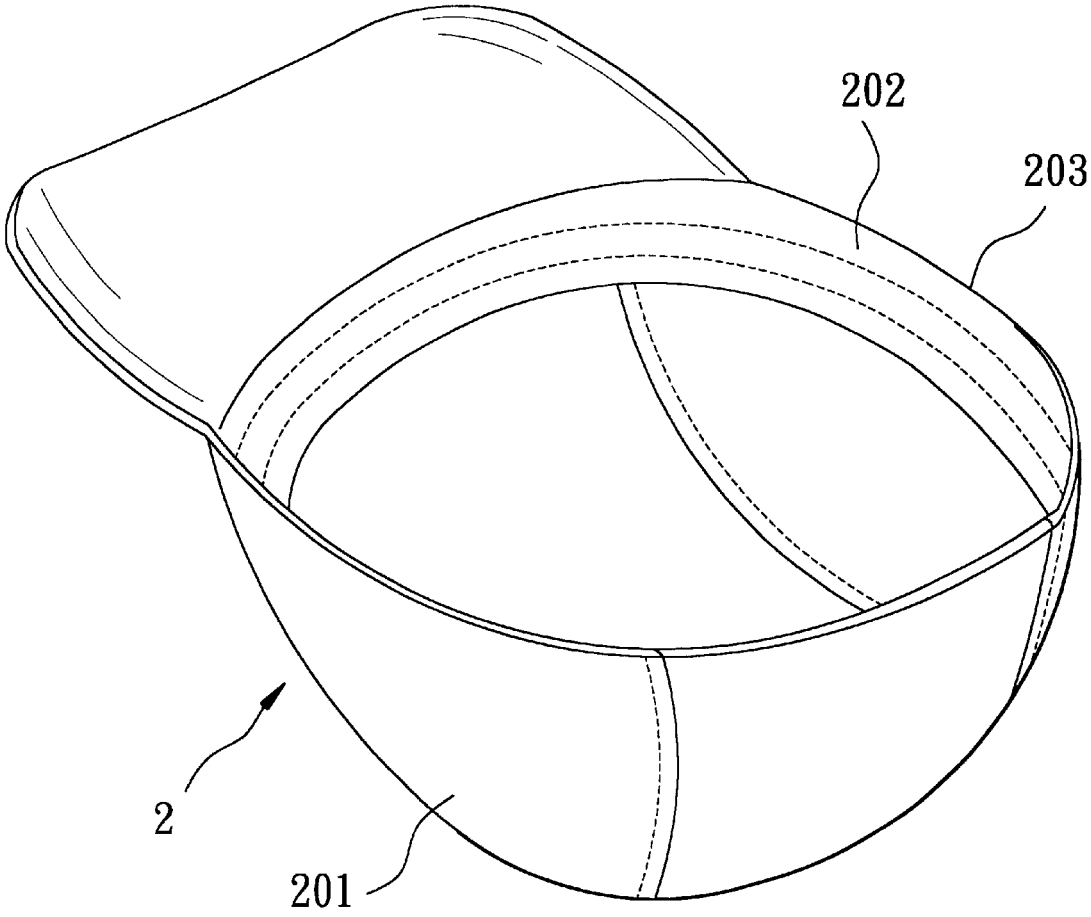
FIG. 2 PRIOR ART
FIG. 2 is a perspective view of another conventional headgear.
Figure 3:
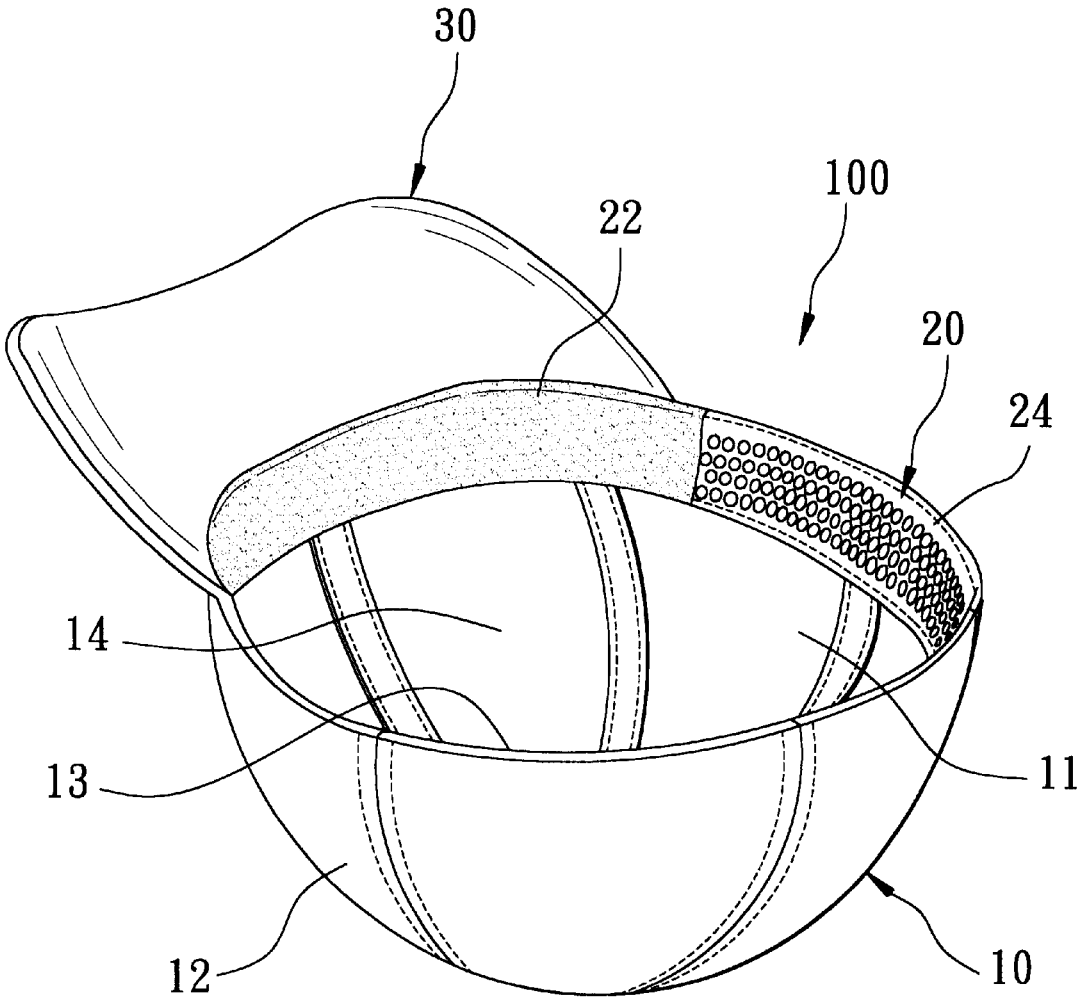
FIG. 3 is a perspective view of the first preferred embodiment of a sweat-absorbing headgear according to this invention.
Figure 4:
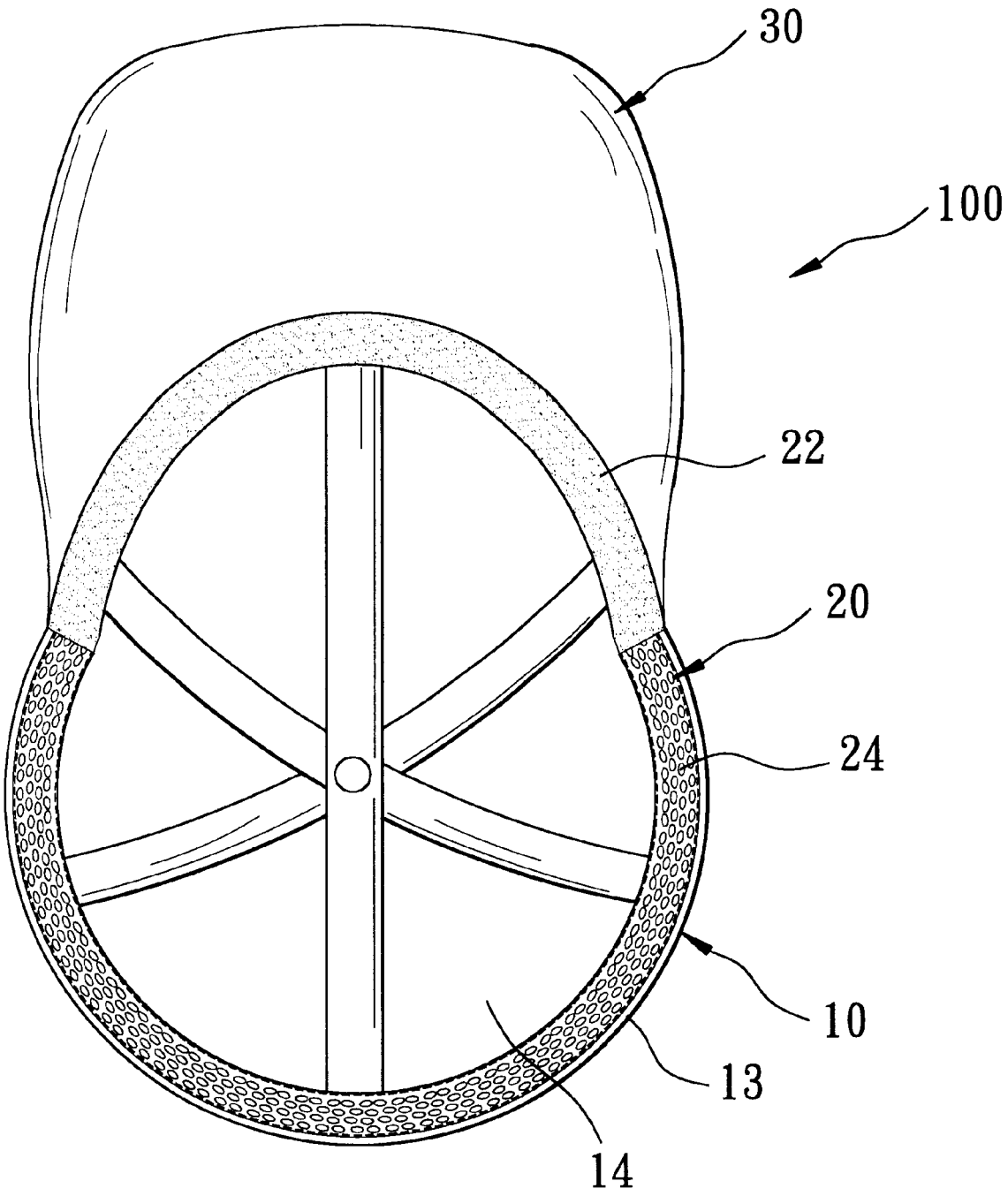
FIG. 4 is a bottom view of the first preferred embodiment.

Referring to FIGS. 3 and 4, the headgear 100 according to the first preferred embodiment of this invention is shown to include a headgear body having a crown portion 10 and a ring portion 20, and a visor 30.

The crown portion 10, which is semi-spherical in shape, has an inner surface 11 and an outer surface 12. The inner surface 11 and the outer surface 12 terminate at a looped marginal end 13 to define a bottom open end 14. The material for the crown portion 10 of this preferred embodiment is composed of 98% cotton fibers and 2% elastic fibers commercially available under the trademark of SPANDEX (elastic textile), thereby imparting the crown portion 10 with elastic characteristics.

The visor 30 is attached to the crown portion 10 at the looped marginal end 13.

Figure 5:
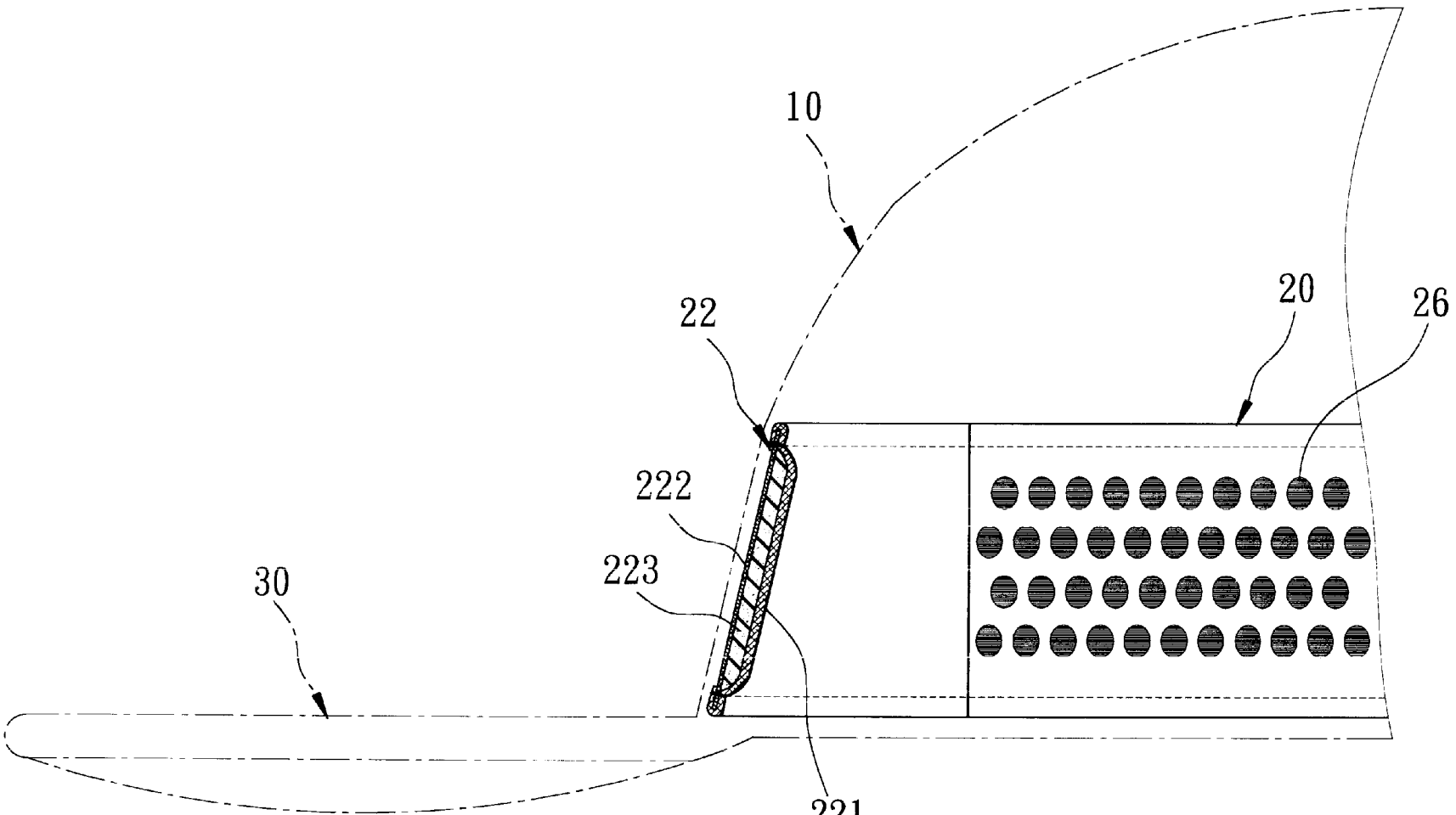
FIG. 5 is a fragmentary sectional view of the first preferred embodiment.

The ring portion 20 is formed as a closed loop and is disposed at the bottom open end 14 on the inner surface 11 of the crown portion 10. The ring portion 20 includes a woven elastic band section 24 and a non-elastic section 22 that is connected to the woven elastic band section 24 and that is disposed to correspond with the forehead of the wearer. The non-elastic, section 22 includes two cloth layers 221 and 222 and a foam layer 223 sandwiched between the two cloth layers 221 and 222, as best shown in FIG. 5.

Figure 6:
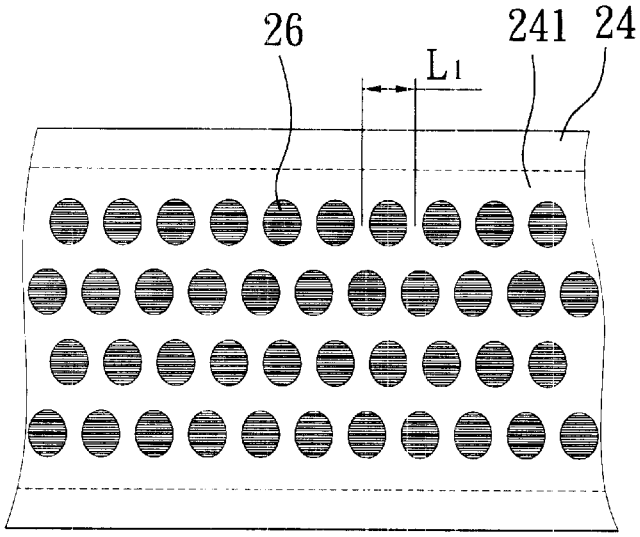
FIG. 6 is a fragmentary plan view of a woven elastic band section of the ring portion in a normally contracted state.
Figure 7:
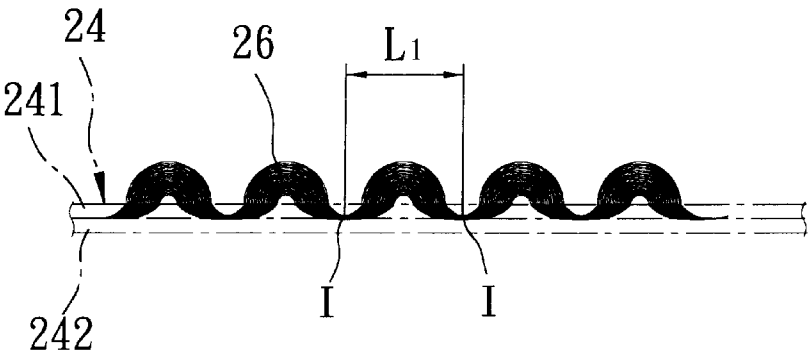
FIG. 7 is a fragmentary schematic view of the woven elastic band section of the ring portion in the normally contracted state.

Referred to FIGS. 6 and 7, the woven elastic band section 24 has an inner first surface 241 facing toward the center of the crown portion 10, and an outer second surface 242 opposite to the first surface 241 and lying against the inner surface 11 of the crown portion 10. The ring portion 20 is changeable in size due to stretchable and contractible characteristics of the woven elastic band section 24. The woven elastic band section 24 includes a plurality of fiber bundles 26 which extend along a longitudinal direction of the woven elastic band section 24 and which are spaced apart transversely. In this embodiment, the fiber bundles 26 are made from polyester. The fiber bundles 26 are stretched when the woven elastic band section 24 is stretched, such as when the headgear 100 is in use, and form a plurality of sweat-absorbing fiber tufts projecting from the first surface 241 of the woven elastic band section 24 when the woven elastic band section 24 returns to a normally contracted state.

Figure 8:
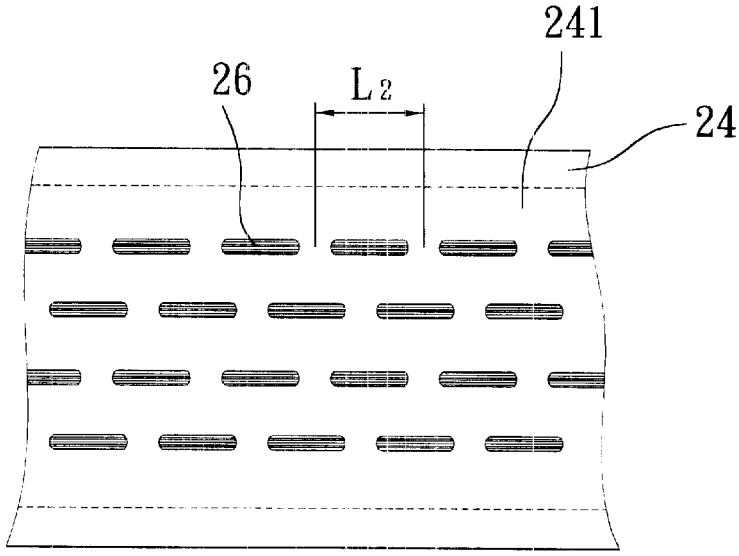
FIG. 8 is a fragmentary plan view of the woven elastic band section of the ring portion in a stretched state.
Figure 9:
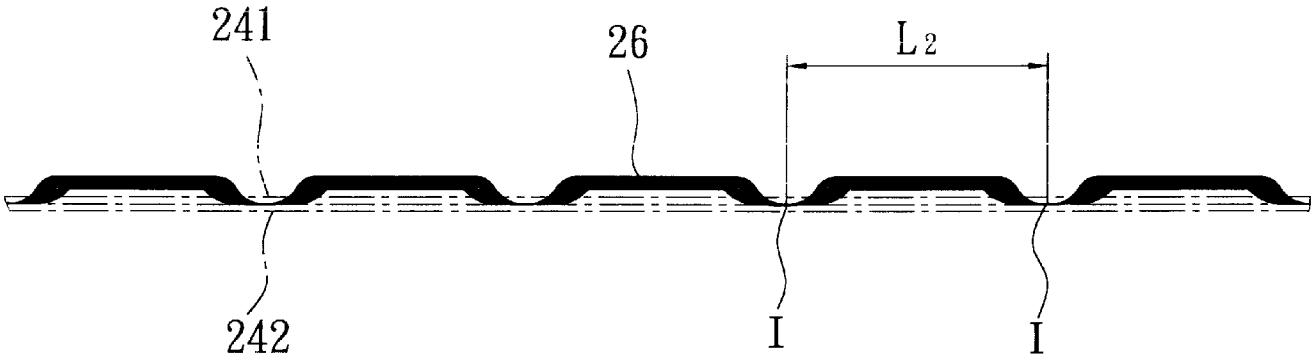
FIG. 9 is a fragmentary schematic view of the woven elastic band section of the ring portion in the stretched state.

During the production of the woven elastic band section 24, the fiber bundles 26 are woven along the longitudinal direction of the woven elastic band section 24 in a stretched state, as illustrated in FIGS. 8 and 9. The fiber bundles 26 are spaced apart transversely. At this time, a distance ($L_2$) is defined between two anchoring points (I) (as shown in FIGS. 8 and 9) of each fiber bundle 26 on the woven elastic band section 24. The woven elastic band section 24 contracts and returns to the state shown in FIGS. 6 and 7 upon completion of the weaving process. At the contracted state, a shorter distance ($L_1$) is defined between two anchoring points (I) of each fiber bundle 26. The fiber bundles 26 form tufts, which project from the first surface 241 of the woven elastic band section 24 at this time. The dimensions of the tufts vary according to the extent of stretching of the woven elastic band section 24.

The sweat-absorbing headgear of this invention has excellent stretchable and contractible characteristics through the elasticity of the woven elastic band section 24. At the same time, a large sweat-absorbing area can be formed by the tufts that project from the first surface 241 of the woven elastic band section 24.

Figure 10:
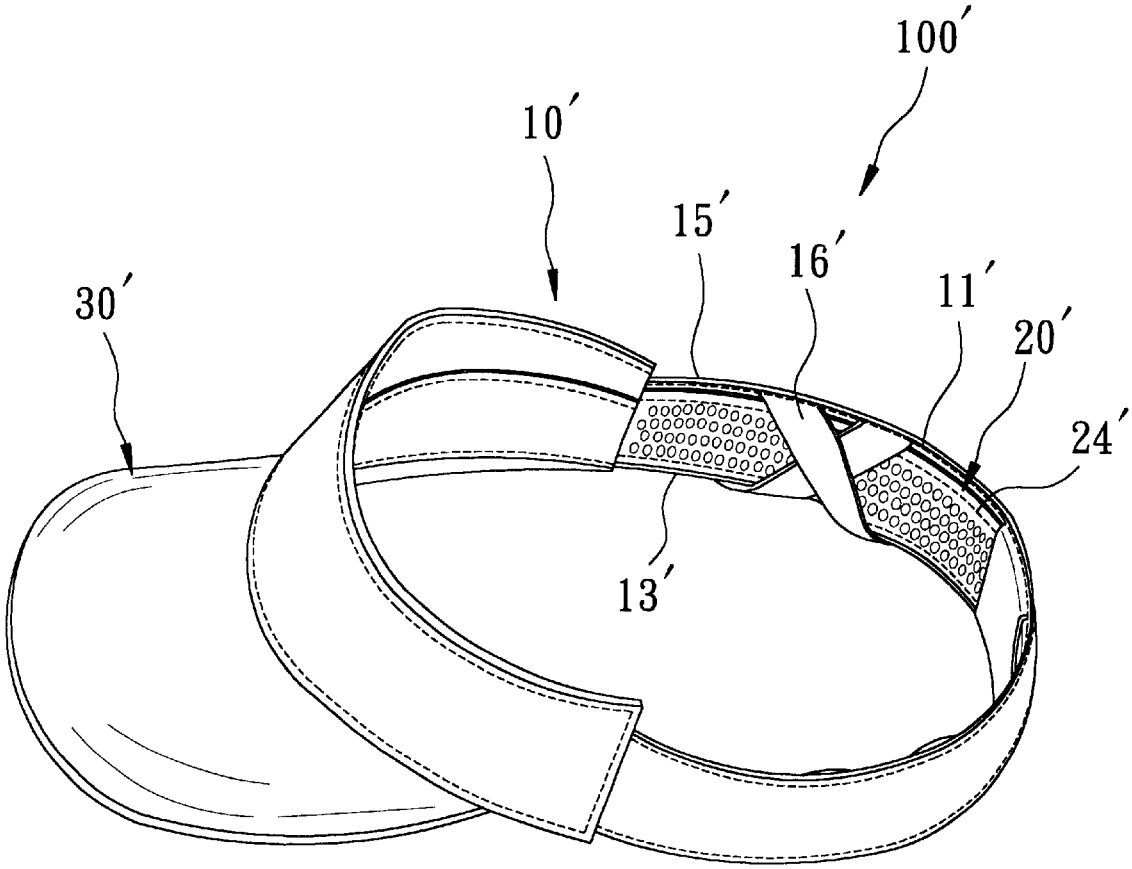
FIG. 10 is a perspective view of the second preferred embodiment of a sweat-absorbing headgear according to this invention.

The sweat-absorbing headgear according to this invention can be formed in various other shapes. FIG. 10 illustrates the second preferred embodiment of the sweat-absorbing headgear 100' according to this invention. The sweat-absorbing headgear 100' includes a headgear body 10', a ring portion 20', and a visor 30'. The headgear body 10' is in the form of a looped band. The woven elastic band section 24' is secured on an inner rear surface 11' of the headgear body 100' by a fixing member 16', that extends between a top edge 15' and a bottom edge 13' of the headgear body 100'.

Figure 11:
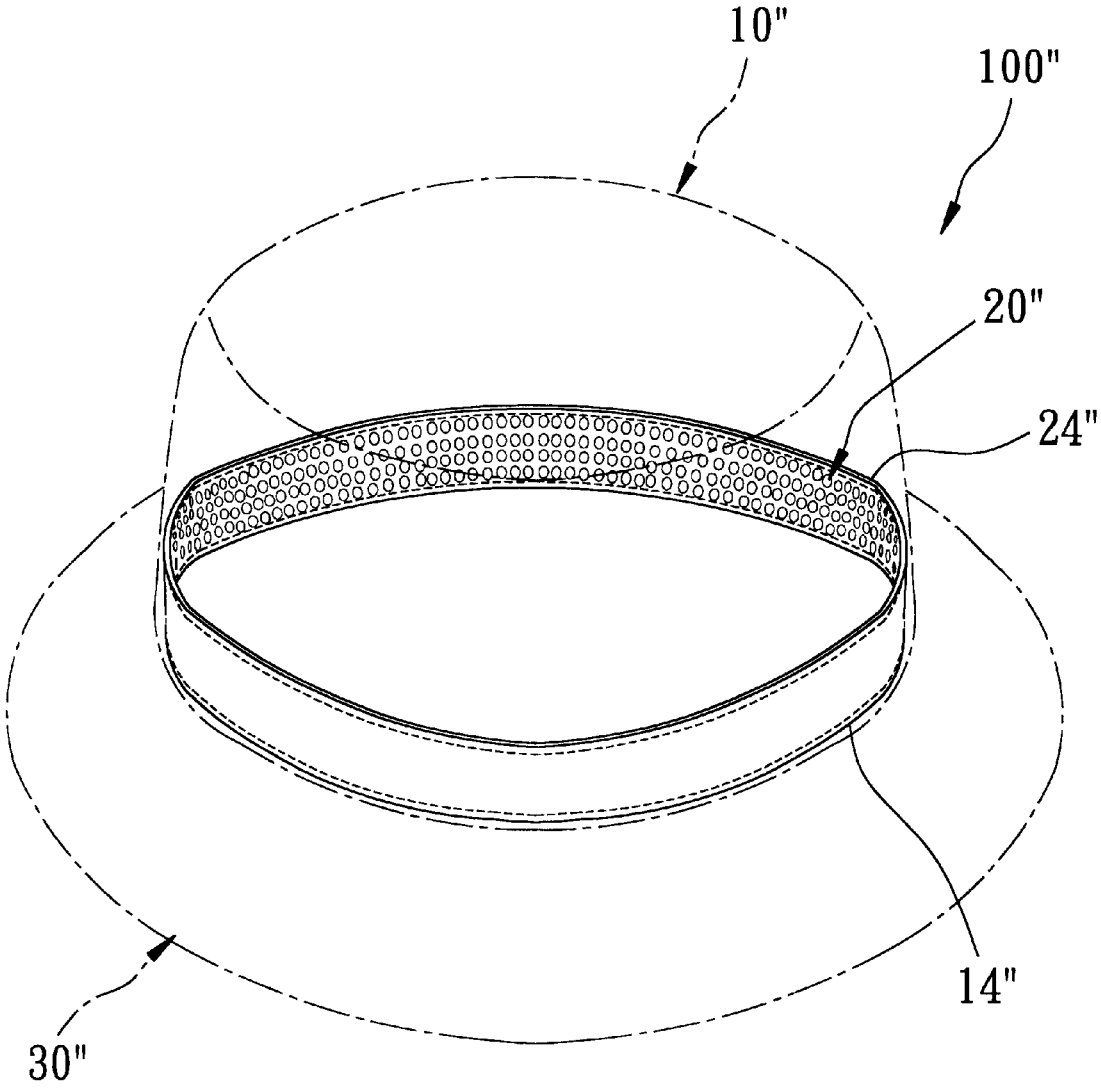
FIG. 11 is a perspective view of the third preferred embodiment of a sweat-absorbing headgear according to this invention.

FIG. 11 illustrates the third preferred embodiment of the sweat-absorbing headgear 100" according to this invention. The sweat-absorbing headgear 100" includes a crown portion 10", a ring portion 20", and a visor 30". The ring portion 20" is not provided with a non-elastic section. In addition, both the woven elastic band section 24" and the visor 30" extend along the entire length of the looped marginal end 14" of the crown portion 10".

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. A sweat-absorbing headgear, comprising:

a headgear body having a ring portion adapted to extend around the head of a wearer, said ring portion including a woven elastic band section and being changeable in size due to stretchable and contractible characteristics of said woven elastic band section, said woven elastic band section being stretchable along a longitudinal direction of said woven elastic band section and including a plurality of fiber bundles which extend along the longitudinal direction and which are spaced apart transversely, said fiber bundles being stretched when said woven elastic band section is stretched, said fiber bundles forming a plurality of sweat-absorbing fiber tufts projecting from an inner surface of said woven elastic band section when said woven elastic band section returns to a normally contracted state;

wherein said ring portion further includes a non-elastic section connected to said woven elastic band section; and wherein said non-elastic section has two cloth layers and a foam layer sandwiched between said two layers.

2. The sweat-absorbing headgear as claimed in claim 1, wherein said headgear body further includes a crown portion which has a bottom open end, said ring portion being disposed at said bottom open end.

3. The sweat-absorbing headgear as claimed in claim 1, further comprising a visor attached to said headgear body.

* * * * *